US007018584B2

(12) United States Patent
Serafini, Jr.

(10) Patent No.: US 7,018,584 B2
(45) Date of Patent: Mar. 28, 2006

(54) METHOD AND APPARATUS FOR METAL PROCESSING

(75) Inventor: Raymond E. Serafini, Jr., Brockway, PA (US)

(73) Assignee: The BOC Group, Inc., Murray Hill, NJ (US)

( * ) Notice: Subject to any disclaimer, the term of this patent is extended or adjusted under 35 U.S.C. 154(b) by 92 days.

(21) Appl. No.: 10/391,144

(22) Filed: Mar. 17, 2003

(65) Prior Publication Data

US 2003/0180173 A1 Sep. 25, 2003

Related U.S. Application Data

(62) Division of application No. 09/803,518, filed on Mar. 9, 2001, now Pat. No. 6,533,996.

(60) Provisional application No. 60/265,918, filed on Feb. 2, 2001.

(51) Int. Cl.
*C21D 1/06* (2006.01)

(52) U.S. Cl. ..... 266/252; 432/198; 432/201

(58) Field of Classification Search ..... 266/249, 266/251, 252; 432/198, 201
See application file for complete search history.

(56) References Cited

U.S. PATENT DOCUMENTS

| | | | | |
|---|---|---|---|---|
| 2,960,744 | A * | 11/1960 | Blank | 422/285 |
| 3,897,358 | A | 7/1975 | Greskovich et al. | |
| 4,139,375 | A | 2/1979 | Solomon et al. | |
| 4,225,344 | A | 9/1980 | Fujimori et al. | |
| 4,365,954 | A * | 12/1982 | Petzi | 432/198 |
| 4,582,301 | A | 4/1986 | Wunning | |
| 4,594,220 | A | 6/1986 | Hasker et al. | |
| 4,728,507 | A | 3/1988 | Worcester | |
| 5,002,009 | A * | 3/1991 | Hayami et al. | 266/252 |
| 5,009,842 | A | 4/1991 | Hendrickson et al. | |
| 5,057,164 | A | 10/1991 | Nillson et al. | |
| 5,069,728 | A | 12/1991 | Rancon et al. | |
| 5,160,765 | A | 11/1992 | Rotman et al. | |
| 5,254,180 | A | 10/1993 | Bonner et al. | |
| 5,298,089 | A | 3/1994 | Bowe et al. | |
| 5,298,090 | A | 3/1994 | Garg et al. | |
| 5,338,008 | A | 8/1994 | Okuno et al. | |
| 5,348,592 | A | 9/1994 | Garg et al. | |
| 5,366,679 | A | 11/1994 | Streicher | |
| 5,441,695 | A | 8/1995 | Gladden | |
| 5,613,185 | A | 3/1997 | Marsden et al. | |
| 5,782,953 | A | 7/1998 | Shah | |
| 5,876,481 | A | 3/1999 | Chagnon et al. | |
| 6,071,469 | A | 6/2000 | Rohlin et al. | |
| 6,190,164 | B1 | 2/2001 | Ueno et al. | |

FOREIGN PATENT DOCUMENTS

| | | |
|---|---|---|
| EP | 803583 | 10/1997 |
| EP | 0962538 A2 | 6/1999 |
| EP | 0962538 A3 | 6/1999 |
| JP | 60224753 | 11/1985 |
| JP | 62185843 | 8/1987 |
| JP | 2093001 | 4/1990 |
| JP | 3146605 | 6/1991 |
| JP | 6002067 | 1/1994 |
| JP | 7118705 | 5/1995 |

* cited by examiner

*Primary Examiner*—Scott Kastler
(74) *Attorney, Agent, or Firm*—Joshua L. Cohen; Bernard Lau

(57) ABSTRACT

A method for metal processing is provided in which a cooling atmosphere comprising hydrogen is used for accelerated cooling of a processed metal part in a furnace, resulting in improved properties for the metal part. A sintering furnace is also provided and comprises a means for inhibiting gas flows between a heating zone and a cooling zone of the furnace.

14 Claims, 7 Drawing Sheets

METHOD AND APPARATUS FOR METAL PROCESSING

CROSS-REFERENCE TO RELATED APPLICATIONS

This application is a divisional of U.S. patent application Ser. No. 09/803,518 filed Mar. 9, 2001, now U.S. Pat. No. 6,533,996 which claims the benefit of U.S. Provisional Application 60/265,918 filed Feb. 2, 2001.

FIELD OF THE INVENTION

The present invention relates generally to a method and apparatus for material processing, and more particularly, to a method and apparatus for sintering metal parts.

BACKGROUND OF THE INVENTION

In metal processing, various thermal treatment operations such as annealing, hardening, brazing and sintering are often performed under inert or reducing atmospheres in order to avoid and/or remove oxidation from metal parts. In powder metallurgy, for example, high pressure is applied to metal powders to form compacts which are then sintered in a furnace to form metal parts. Sintering of the compacts is typically performed under an inert or reducing atmosphere such as a mixture of nitrogen ($N_2$) and hydrogen ($H_2$) or an Endo gas mixture containing carbon monoxide (CO), $H_2$ and $N_2$. The sintered metal parts are then subjected to a cooling phase, during which transformation of the microstructure of the metal parts may occur. Certain metal parts may also be subjected to sinterhardening, i.e., transformation to a hard martensite phase during cooling. Sinterhardening is typically carried out in a cooler such as a convection cooler, with alloy additives such as nickel, molybdenum, among others, added to the metal powders prior to sintering. These alloy additives are used to facilitate sinterhardening of the metal parts, resulting in products that are either harder or tougher than non-sinterhardened parts. Water coolers, which provide slower cooling than convection coolers, may also be used with more expensive types of powder mix to provide metal parts with increased martensite phase.

Much of the efforts for improving sintering methods have focused on the control of process conditions during sintering. However, since the transformation of microstructure during the cooling phase directly affects the material properties of the processed parts, there is a need for an improved method of sintering by controlling process conditions during the cooling phase.

SUMMARY OF THE INVENTION

The present invention provides generally a method and an apparatus for metal processing. According to one aspect of the invention, a method is provided for sintering a workpiece in a heating zone of a furnace, and exposing the workpiece in a cooling atmosphere in a cooling zone of the furnace. In one embodiment, the cooling atmosphere contains at least about 15% of hydrogen, at least a portion of which is introduced via an inlet within the cooling zone.

In another embodiment of the invention, a method provides for sintering a powder metal part in a heating zone of a furnace, and exposing the powder metal part to a cooling atmosphere in a cooling zone of the furnace. The cooling atmosphere comprises a first gas at a concentration of at least about 25% and a second gas at a concentration of at least about 5%. The first gas is selected from hydrogen, helium and combinations thereof, while the second gas is selected from nitrogen, argon and combinations thereof. At least a portion of the first gas is introduced into the cooling zone via an inlet in the cooling zone.

In yet another embodiment, a method provides for sintering a workpiece in a heating zone of a furnace, introducing hydrogen to form at least a part of a cooing atmosphere in a cooling zone adjoining the heating zone, and exposing the workpiece to the cooling atmosphere. The hydrogen is introduced via an inlet that is configured such that the hydrogen reaches the cooling zone prior to the heating zone, and the cooling atmosphere contains sufficient hydrogen to provide a cooling rate for the workpiece that is at least about 30% higher than a cooling rate obtained in a cooling atmosphere containing no hydrogen.

In yet another embodiment, a method provides sintering a workpiece in a heating zone of a furnace, and cooling the workpiece in the cooling zone by exposing it to a cooling atmosphere containing hydrogen. At least a portion of the hydrogen is introduced via an inlet within the cooling zone, and the cooling atmosphere has a hydrogen concentration that is at least about 10% higher than a hydrogen concentration in the heating zone.

Another aspect of the present invention provides for a sintering furnace comprising a heating zone, a cooling zone with a gas inlet for introducing a cooling feedgas comprising hydrogen, and a means for inhibiting gas flow between the cooling zone and the heating zone.

BRIEF DESCRIPTION OF THE DRAWINGS

While the specification concludes with claims distinctly pointing out the subject matter that the applicants regard as their invention, it is believed the invention would be better understood when taken in connection with the accompanying drawings in which:

DETAILED DESCRIPTION

The present invention provides generally a method and apparatus for metal processing. According to one aspect of the invention, a processed part that has been subjected to high temperature processing or treatment is exposed to a cooling atmosphere containing a relatively high concentration of hydrogen. By controlling the cooling rate of the processed parts, e.g., providing accelerated cooling in the hydrogen-containing atmosphere, certain desirable material properties can be obtained. Another aspect of the invention provides an apparatus adapted for inhibiting or reducing gas flows between a heating zone and a cooling zone. By confining the hydrogen-containing cooling atmosphere generally to around the cooling zone, hydrogen in the cooling atmosphere can be used in a more cost effective manner.

Figure 1:
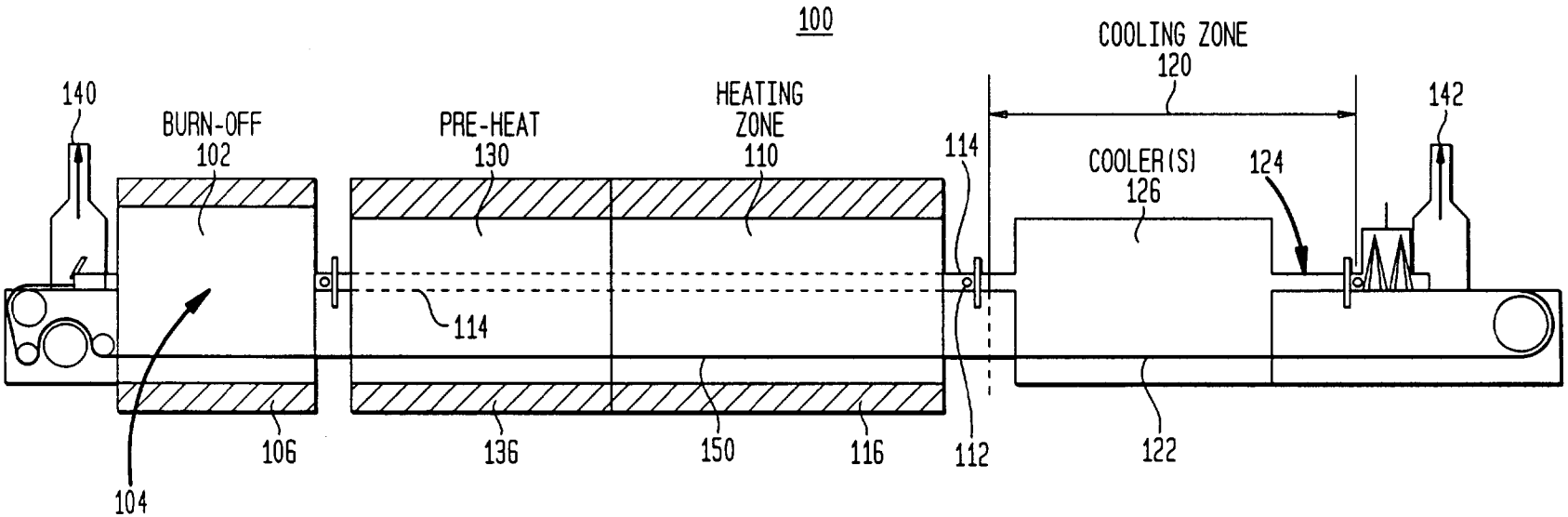
FIG. 1 is a schematic view of a furnace that can be used for practicing one embodiment of the present invention.

In one embodiment, the method of the present invention is applied to sinterhardening of metal parts that have been subjected to sintering in a furnace. FIG. 1 is a schematic illustration of a cross-section of an apparatus 100, or a furnace, that can be adapted for practicing sintering according to the present invention. The furnace 100 of FIG. 1 is a continuous belt sintering furnace similar to those available from various commercial suppliers, e.g., Abbott Furnace Company, of St. Mary's, Pa. The furnace 100 comprises a pre-heat or burn-off zone 102, a heating or sintering zone 110 and a cooling zone 120, with a conveyor belt 150 for transporting workpieces (not shown) to different parts of the furnace 100. In some cases, a second pre-heat zone 130 may also be provided between the burn-off zone 102 and the heating zone 110. The pre-heat zones 102, 130 and the heating zone 110 are usually insulated, e.g., by surrounding insulation 106, 136 and 116. The cooling zone 120 may generally be defined as a region after the heating zone 110 within which cooling of the metal parts takes place, e.g., in a cooler 126. It is understood that one or more coolers may be provided in the cooling zone 120. Alternatively, in configurations in which there is an extended non-insulated region downstream of the heating zone 110, the cooling zone 120 may also include portions of such non-insulated region. For illustrative purpose, the various zones of the furnace 100 are depicted as discrete zones in FIG. 1. However, it is understood that in practice, there is usually a continuous transition of thermal characteristics or gas compositions between any two adjacent zones. Thus, it is possible that some degree of cooling takes place within the heating zone 110, as may occur near the downstream end closer to the cooling zone 120. The furnace 100 is typically operated at atmospheric pressure, with venting flues 140 and 142 provided at one or both ends of the furnace 100 for exhausting process gases. Since there is usually no partitions or barriers between different zones in a commercially available continuous belt furnace, gases introduced at one zone of the furnace are often transported to other zones. The conveyor belt 150 may be made from a variety of materials or alloys, e.g., stainless steel, that are capable of withstanding the furnace environment, and may be operated at speeds between about 4 and about 8 inches per minute (in./min.).

Incoming workpieces first enter the pre-heat or burn-off zone 102 for pre-sintering treatment. The burn-off zone 102 is typically maintained at an elevated temperature, e.g., up to about 1200° F. The gaseous atmosphere in the burn-off zone 102 usually comprises a relatively high dew point gas mixture, which may be generated by the combustion of a fuel, e.g., methane ($CH_4$), in an external burner (not shown). Combustion products such as CO, carbon dioxide ($CO_2$), $N_2$ and water ($H_2O$), along with any residual gases such as $CH_4$ and oxygen ($O_2$) are injected into the burn-off zone 102 via a gas inlet 104. The temperature in the burn-off zone 102 should be sufficiently high such that lubricants in powder metal parts may be vaporized prior to sintering. Other gases such as hydrogen, argon, helium, or $N_2$, among others, may also be present.

After pre-sintering treatment, workpieces or metal parts are transported from the burn-off zone 102 to the second pre-heat zone 130 (if present), and subsequently to the heating zone 110 for sintering under a reducing atmosphere. In general, sintering conditions such as temperature or gas composition may vary according to the specific materials and applications. For sintering of powder metal parts, the heating zone 110 may generally be maintained within a temperature range between about 2000° F. and about 2400° F. For many applications, the sintering atmosphere may contain a feedgas mixture of $N_2$ and $H_2$, with a $H_2$ concentration in the mixture being typically less than about 8%. The $N_2$ and $H_2$ feedgas may be pre-mixed and supplied to the heating zone 110 via a gas inlet 112, with its flow rate being controlled by flow controllers (not shown). The gas inlet 112 in commercial furnaces is usually located in a transition zone between the heating zone 110 and the cooling zone 120, e.g., in an exposed tube portion that is also called a muffle 114. It is also possible, however, that a gas inlet be provided at a location within the heating zone 110 for introducing the sintering feedgas. Using an open-ended atmospheric furnace such as that of FIG. 1, the sintering gases introduced at gas inlet 112 will flow upstream towards the heating zone 110 and the second preheat zone 130, as well as downstream towards the cooling zone 120. The $N_2$ and $H_2$ feedgas mixture is preferably one with a relatively low dew point, e.g., between about −30° F. and about −40° F., in order to avoid undesirable effects arising from the presence of moisture. For example, the presence of moisture may hinder the sintering of iron-containing parts by lowering the ability of the sintering atmosphere to remove oxygen from iron oxide, which is required for sintering iron-containing metals. For workpieces such as stainless steel parts, a higher concentration of $H_2$, e.g., up to 100% $H_2$ in the feedgas, may be used for sintering. Alternatively, the sintering atmosphere containing $N_2$ and $H_2$ may be supplied to the heating zone 110 by using dissociated ammonia, which provides a feedgas mixture of about 25% $N_2$ and about 75% $H_2$ from dissociation of anhydrous ammonia in a catalytic reactor (not shown). Depending on the specific sintering application, the $N_2$ and $H_2$ mixture from dissociated ammonia is further diluted with additional $N_2$ or inert gases prior to being introduced into the furnace 100. Furthermore, the sintering atmosphere may also be provided by an Endo gas, comprising about 20% CO, 40% $H_2$, balance $N_2$, from an Endo generator (not shown).

After exiting the heating zone 110, cooling of the metal parts may proceed in different stages or at different cooling rates, which may vary with the configuration or design of the furnace 100. For example, in a transition region such as the muffle 114, the temperature of the metal parts is still relatively high and radiant cooling may be the key mechanism. As the temperature of the metal parts continues to decrease, convective cooling may become dominant. For many iron-carbon metal parts, microstructure phase changes becomes important at temperatures less than about 1100° F. Thus, the cooling rate at temperatures between about 1200° F. and about 500° F. is of particular interest, and it is believed that improved material properties can be achieved by controlling the cooling rate in this temperature regime. Depending on the specific metal parts, however, other temperature regimes may be important for process control purposes.

As previously mentioned, a portion of the cooling zone 120 may correspond to regions defined by one or more coolers, including water cooler and convection cooler. An example of a convection cooler suitable for practicing embodiments of the invention is a Dreaver Convecooler, which is available from Dreaver Company, of Huntington Valley, Pa. In such a recirculating-type of cooler, gases are drawn from the cooling zone 120 by a fan in the cooler (not shown). These gases are passed through a heat exchanger (not shown) and re-introduced back to the cooling zone 120 for cooling the sintered parts. Coolers of other designs may also be used. Depending on the cooler design, a gas inlet 122 may also be provided to the cooler for introducing additional gases from an external source to the cooling zone 120. In conventional sintering practice, the composition of the gaseous atmosphere in the cooling zone 120 is generally similar to that in the heating zone 110. Thus, in the absence of any additional cooling gas from an external source, the $H_2$ concentration in the cooling zone 120 can only be as high as that found in the heating zone 110. For example, in many conventional sintering furnaces using a sintering atmosphere containing $H_2$ and $N_2$, the $H_2$ concentration in the cooling zone 120 is often below 10%.

According to the present invention, a gas containing $H_2$ from an external gas source (i.e., aside from the $H_2$ drawn from that already in the cooling zone 120) is introduced or injected to the cooling zone 120 via a gas inlet within the cooling zone 120. This externally supplied cooling gas preferably has a low dew point, e.g., at least below about −30° F. (or corresponding to a moisture content of less than about 250 parts per million), preferably less than about −40° F. The cooling gas may be introduced into the cooling zone 120 either directly via an inlet 124 connected to the external source, or indirectly through the cooler 126, i.e., via a gas inlet 122 of the cooler 126. It is also possible that the cooling gas be introduced to the cooling zone 120 via an inlet located downstream of the cooling zone, as long as there is sufficient gas flow towards the cooling zone 120 such that an appropriate cooling atmosphere be established in the cooling zone 120. Alternatively, the externally supplied cooling gas may also contain $N_2$ or other inert gases such as argon (Ar), helium (He), among others, in addition to $H_2$. For example, helium, which also has a higher thermal conductivity than $N_2$, may be used to provide accelerated cooling. In general, however, $H_2$ is preferred due to its lower cost compared to He. In one embodiment, the externally supplied cooling gas is a mixture containing a gas such as $H_2$ or He and another gas such as $N_2$ or Ar, or combinations thereof. The $H_2$ and/or He gas should be present in a sufficiently high concentration in the cooling atmosphere to provide an effective cooling rate for improving the properties for the processed parts. The concentration necessary to effect certain improved properties may depend on the specific compositions of the processed parts, or with the configurations of the furnace.

Depending on the exact configuration and the relative gas flows in the heating zone 110 and the cooling zone 120, it is also possible that $H_2$ introduced to the cooling zone 120 be transported upstream to the heating zone 110. This may give rise to a sintering atmosphere having a $H_2$ concentration that is higher than that found in the original sintering feedgas mixture. In one embodiment of the invention, the $H_2$ concentration in the heating zone 110 is determined prior to the injection of $H_2$ to the cooling zone 120; while the $H_2$ concentration in the cooling zone 120 is determined after injection of $H_2$ to the cooling zone 120, e.g., during cooling of the sintered parts under operating conditions. The $H_2$ gas should be introduced in an amount or concentration that is sufficient for effective control of the cooling rate of the metal parts within a temperature range of interest. For example, the $H_2$ concentration in the cooling zone during operation should be at least about 10% higher than the $H_2$ concentration in the heating zone, as measured prior to the injection of $H_2$ to the cooling zone 120. Thus, if the $H_2$ in the heating zone is about 5% before injection of $H_2$ to the cooling zone 120, the cooling zone 120 should have a $H_2$ concentration of at least about 15% during operation.

In another embodiment, sintered metal parts in the cooling zone 120 are exposed to a gaseous atmosphere having a $H_2$ concentration that is higher than that available in the heating zone 110 during operation (e.g., under operating or steady state conditions). Preferably, the cooling atmosphere should have a $H_2$ concentration in the cooling zone 120 that is at least about 10% higher than the $H_2$ concentration in the heating zone 110, both concentrations being determined during steady state conditions. Due to the higher thermal conductivity of $H_2$ compared to other gases typically found in the cooling zone 120, an increase in the $H_2$ concentration in the cooling zone 120 is expected to result in accelerated cooling of the sintered parts. Thus, cooling rates of sintered parts may be controlled by varying the amount of $H_2$ in the cooling atmosphere, and it is possible to optimize the cooling process in order to achieve desired material properties in the processed parts. For powder metal parts, it is desirable that the cooling rate be controlled, e.g., accelerated, within a temperature range of about 1500° F. to about 200° F., or from about 1100° F. to about 600° F.

In practicing the present invention, it is preferable that the $H_2$ gas introduced for cooling rate control be confined generally to the cooling zone 120. This may be achieved, for example, by modifying the furnace 100 to inhibit gas flows from the cooling zone 120 to the heating zone 110, or vice versa. Thus, a barrier such as a curtain made of ceramic fiber, or a gas curtain formed by an inert gas flow, may be provided between the cooling zone 120 and the heating zone 110. Alternatively, gas flows within the furnace 100 may be arranged to provide a positive flow from the heating zone 110 to the cooling zone 120, e.g., by the use of an auxiliary fan. Such modifications are especially important for applications in which a high $H_2$ concentration in the heating zone 110 may cause undesirable results.

For example, in the sintering of certain metal parts containing iron and carbon (i.e., non-stainless steel), a high $H_2$ concentration in the heating zone 110 may lead to decarburization of the metal parts. Such decarburization may occur when $H_2$ reacts with an oxide layer on the conveyor belt 150. It is believed that moisture from such a reaction may subsequently react with carbon from the metal parts, leading to decarburization. Furthermore, when the oxide layer from the surface of the conveyor belt 150 is reduced by $H_2$, portions of the conveyor belt 150, which has a spiral shape, may become sintered to each other due to the expose chrome surface, and breakage may eventually result due to the decreased flexibility of the conveyor belt 150. Finally, if the ratio of $H_2$ to $H_2O$ in the sintering atmosphere is too high, certain metal deposits (believed to originate from some component of the conveyor belt 150) may be formed on the muffle 114, which would cause belt breakage due to the weakening of the conveyor belt 150 as it moves over the metal deposit. For these reasons, it is desirable to minimize upstream flow of $H_2$ to the heating zone 110, especially if a relatively high concentration of $H_2$ is to be introduced into the cooling zone 120.

Figure 2:
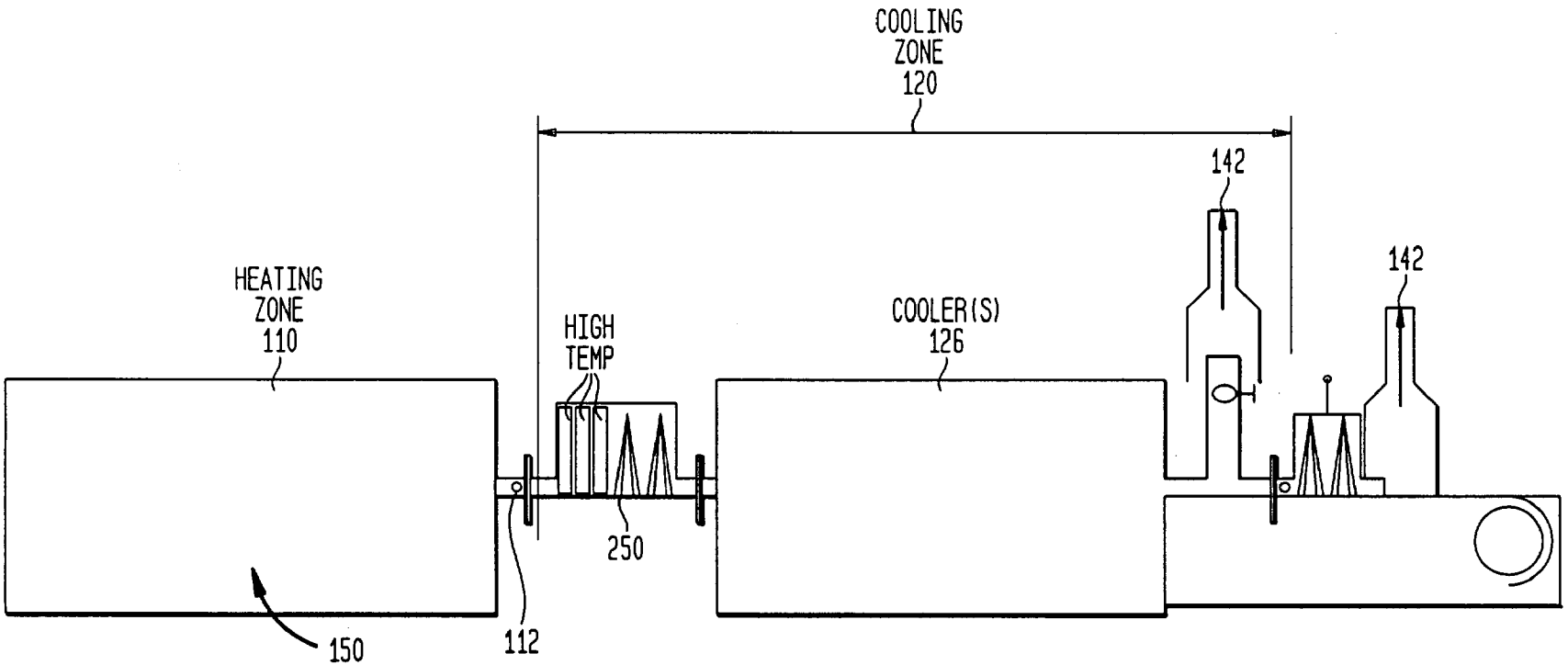
FIG. 2 is a schematic view of portions of a furnace according to one embodiment of the present invention.
Figure 3:
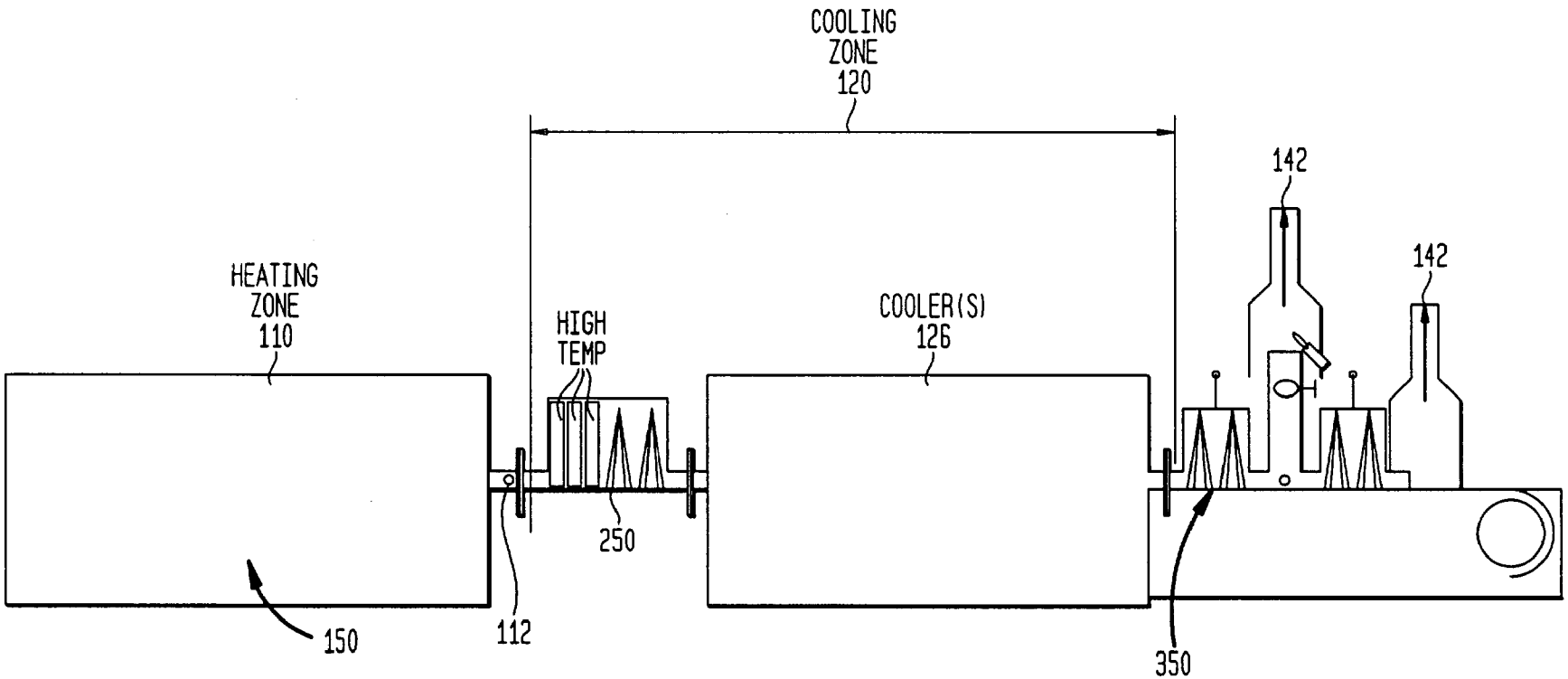
FIG. 3 is a schematic view of portions of a furnace according to another embodiment of the present invention.
Figure 4:
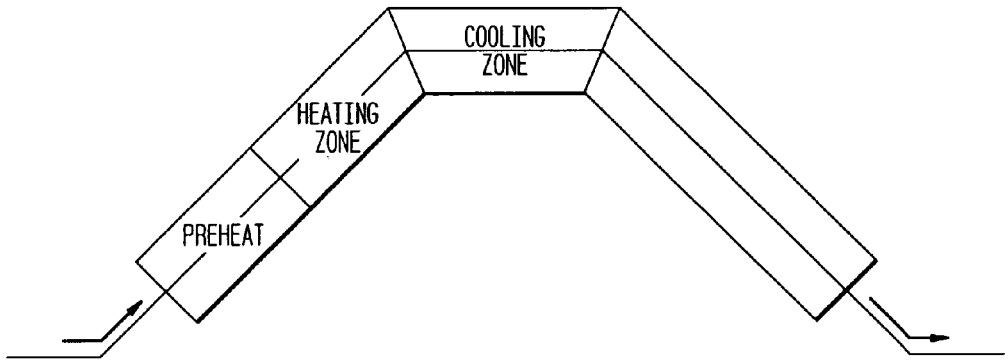
FIG. 4 is a schematic view of a furnace configuration suitable for practicing one embodiment of the present invention.
Figure 5:
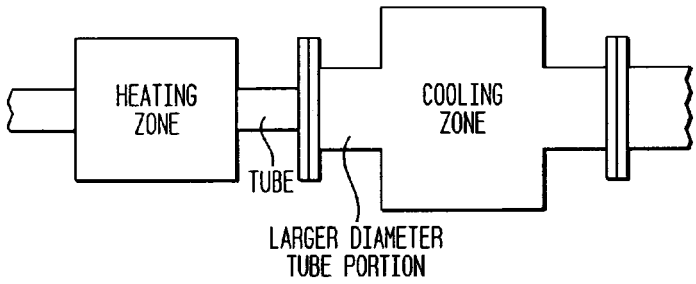
FIG. 5 is a schematic view of another furnace configuration suitable for practicing one embodiment of the present invention.

Thus, another aspect of the present invention relates to furnace configurations for practicing different embodiments of the invention. FIG. 2 and FIG. 3 are schematic illustrations of portions of a furnace adapted for providing restricted gas flow between the heating and cooling zones. Referring to FIGS. 2 and 3, the curtain box 250, for example, may provide an effective gas flow barrier such that upstream flow of the cooling gas (containing a high concentration of $H_2$) to the heating zone can be minimized. FIG. 3 illustrates another embodiment in which an additional curtain 350 may be provided downstream of the convection cooler to further restrict the flow of cooling gases out of the cooling zone 120. As such, the $H_2$ gas introduced to the cooler may be more effectively utilized for cooling of the metal parts. Other means for inhibiting backflows from the cooling zone to the heating zone can also be employed, including gas flow control. Such gas flow control may be provided, for example, in furnace configurations such as those shown in FIGS. 4 and 5. FIG. 4 illustrates a hump back furnace, whose heating zone 410 is located at a lower height compared to the cooling zone 420, and is oriented in an inclined position. FIG. 5 illustrates a furnace in which a "step" is provided in a tube between the heating zone 510 and the cooling zone 520. That is, the tube portion 535 closer to the cooling zone 520 has a larger diameter compared to the tube portion 530 closer to the heating zone 510. These furnace configurations may provide a preferential gas flow from the heating zone towards the cooling zone, which may help minimize the backflow of excessive $H_2$ to the heating zone.

Although the above discussion has focused on the use of a continuous belt furnace, it is understood that other types of furnaces may also be used. For example, furnaces such as a vacuum furnace, a pusher furnace, a walking beam furnace, or a roller hearth furnace, among others known to one skilled in the art, are also suitable for practicing embodiments of the invention. A pusher furnace or a walking beam furnace, which has a gate for effectively separating the heating and cooling zones, may be especially well suited for applications that require a restricted upstream $H_2$ flow to the heating zone. A convection cooler may also be retrofitted to these furnaces.

By injecting $H_2$ to the cooling zone of a furnace such that the cooling atmosphere has a relatively high $H_2$ concentration, many advantages may be achieved compared to conventional practice. For example, the use of increased $H_2$ in the cooling atmosphere allows accelerated cooling of the metal parts, and may result in improved material properties or characteristics due to changes in the microstructure of the processed parts. In the case of sinterhardening, accelerated cooling with increased $H_2$ in the cooling zone may result in metal parts that are either harder and/or tougher than those typically produced from conventional cooling. Furthermore, by providing more efficient cooling through increased $H_2$ concentration in the cooling gas, the recirculating fan in the convection cooler can be operated at a reduced speed, resulting in cost reduction as well as a more stable cooling atmosphere. It is believed that a more stable or reproducible atmosphere during sinterhardening may help achieve favorable characteristics in the processed parts.

Moreover, an improved sinterhardening process allows a reduced amount of alloy powder additives to be used, which also leads to more compressible or denser metal parts. With improved part properties, not only can a less expensive powder mix be used for meeting existing part requirements, but sintered parts can also be used in more demanding applications than otherwise possible. In situations where cooling of the metal parts is a limiting factor in the production throughput, a more rapid cooling (thus, shorter cooling time) will also lead to an increased production rate. In addition, accelerated cooling may also allow a furnace with a shorter cooling zone to be used, and thus, provide a reduction in floor space requirement.

EXAMPLES

To further illustrate embodiments of the present invention, a series of tests was performed on various powder metal parts to demonstrate the effect of different cooling atmospheres on sinterhardening. Powder metal samples containing iron (Fe), carbon (C), nickel (Ni), molybdenum (Mo), manganese (Mn) and sulfur (S) at various compositions, all available from Domfer Metal Powders, Inc., of Montreal, Canada, were first heated to a temperature above their austenizing temperatures to bring about a total austenitic phase transformation in the metal powder part, and then cooled under different cooling atmospheres. Hardness measurements and microstructure analyses performed on some of the processed samples indicated a correlation between a higher cooling rate and improved microstructure and increased hardness.

Testing was performed in a laboratory furnace having an open-ended configuration for atmospheric pressure operations. The furnace had a heating zone and an adjoining cooling zone. Gases used for heating or cooling the samples were introduced via a gas inlet located in the cooling zone such that a steady gas flow from the cooling zone to the heating zone was maintained during heating or cooling. Temperatures of the samples were monitored by four thermocouples attached to different parts of each sample, with one thermocouple being placed on the surface and three others embedded in the sample—one at the center, and two at intermediate distances between the center and the surface.

A powder metal sample, in the form of a 1.125 inch diameter, 1 inch high cylinder, was first placed inside the heating zone containing a heating atmosphere. For most of the test samples, a feedgas containing 100% $N_2$ is supplied to the heating zone to form the heating atmosphere. However, mixtures of $N_2$ and $H_2$ at various compositions (from 0% to 100% $H_2$) were also used in some of the tests to assess the effect of a hydrogen-containing atmosphere on the heating rate. After the center of a sample reached a desired temperature, e.g., about 950° C. for a majority of the tests, it was heated for another 20 minutes in the heating zone before being positioned in the adjoining cooling zone and exposed to a cooling atmosphere. Thermal profiles of the samples were obtained by monitoring the thermocouple temperatures throughout the heating and the cooling stages.

Different cooling atmospheres containing various concentrations of $H_2$, e.g., from 0% to 100%, balance $N_2$, were used to provide different cooling rates for the samples. In this furnace configuration, there is no appreciable gas flow from the heating zone to the cooling zone. Cooling curves for the sample were obtained by recording the thermocouple temperatures as the sample cooled to below about 200° C. Some of the process parameters used in the series of tests are given in Table 1 below.

TABLE 1

Sample Compositions:

#1: 0.45% Ni, 0.7% Mo, 0.4% Mn, 0.65% C, balance Fe (Domfer MP52)

#2: 0.45% Ni, 0.7% Mo, 0.4% Mn, 0.65% C, 2% Cu, balance Fe (Domfer MP52+2Cu).

#3: 1.8% Ni, 0.73% Mo, 0.5% Mn, 0.65% C, balance Fe (Domfer MP55).

#4: 0.25% S, 1.3% Mo, 0.7% Mn, 0.65% C, 2% Cu, balance Fe (Domfer MP59FM+2Cu).

Heating atmosphere compositions: 100% $N_2$; mixtures of $N_2$ and $H_2$.

Cooling atmosphere compositions: Mixtures of $H_2$ and $N_2$.

Gas flow velocities: 100 ft/sec.–350 ft/sec.

Figure 6:
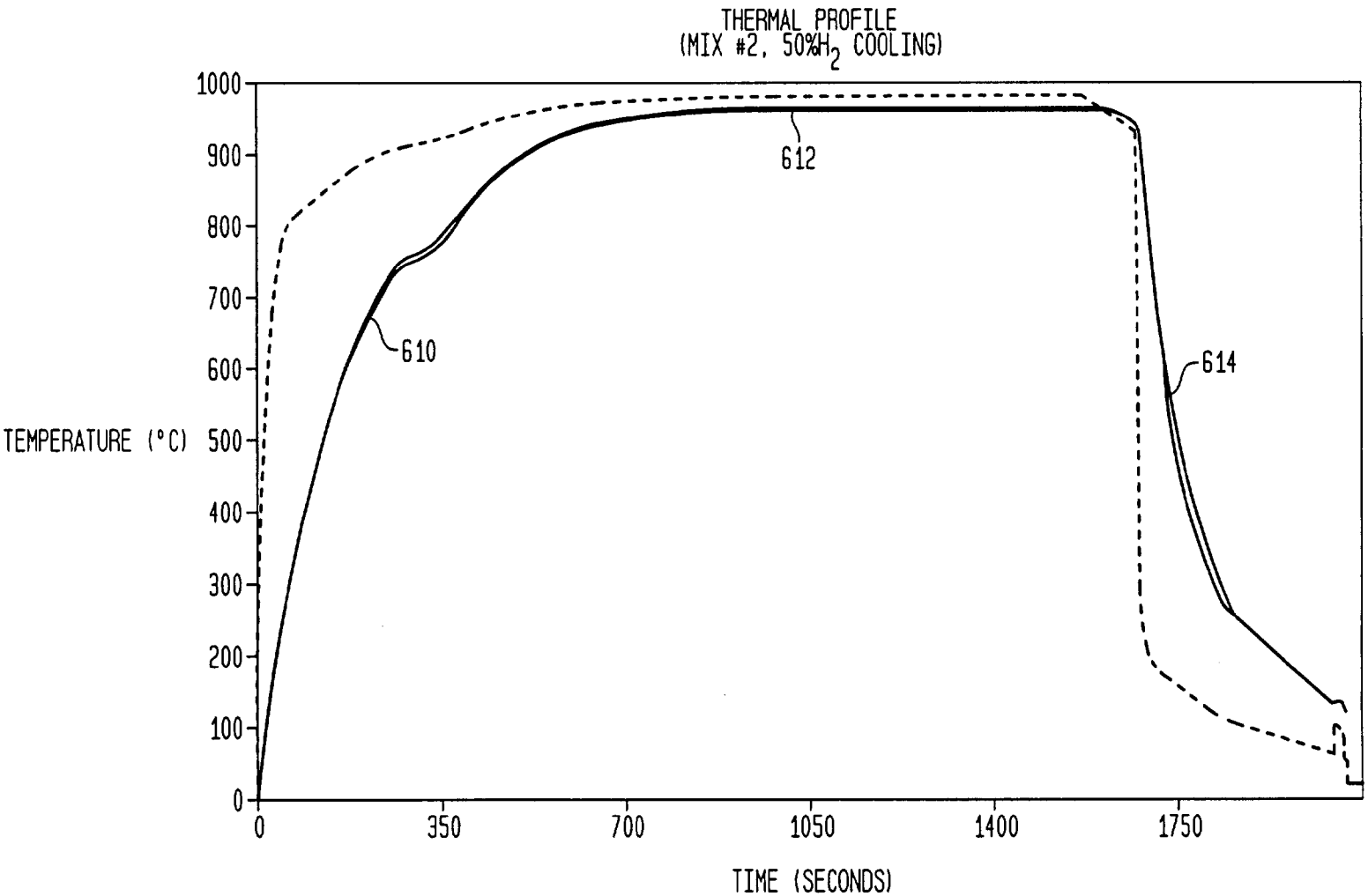
FIG. 6 is a plot of the thermal profiles for a powder metal sample undergoing thermal processing.

FIG. 6 illustrates the thermal profiles for one of the powder samples #2, showing the thermocouple temperatures as a function of processing time. The thermal profile at the sample surface is shown as a dashed line, while those corresponding to the embedded thermocouples essentially overlap with each other. The thermal profile is typically characterized by an initial heat-up curve 610, a heating curve 612, and a cooling curve 614. For tests performed with heating atmospheres containing $H_2$ and $N_2$, the heat-up curves showed that a higher $H_2$ concentration resulted in an increased heating rate. The increase in heating rate becomes more significant for a $H_2$ concentration above approximately 25%. For example, in one sample, a sintering mixture containing about 50% $H_2$ resulted in a heating rate that was about 1.3 times of that obtained from 100% $N_2$, while a 75% $H_2$ mixture gave rise to about 1.6 times of the heating rate from $N_2$ alone. After the sample temperature had stabilized, the sample was heated (shown by the heating curve 612) for a time duration sufficient for a complete phase transition of the powder metal samples. It was then positioned in the cooling zone of the furnace and exposed to a cooling atmosphere, which may or may not be the same as the heating atmosphere. Gases for the cooling atmospheres comprised mixtures of $N_2$ and $H_2$ at various concentrations.

Figure 7:
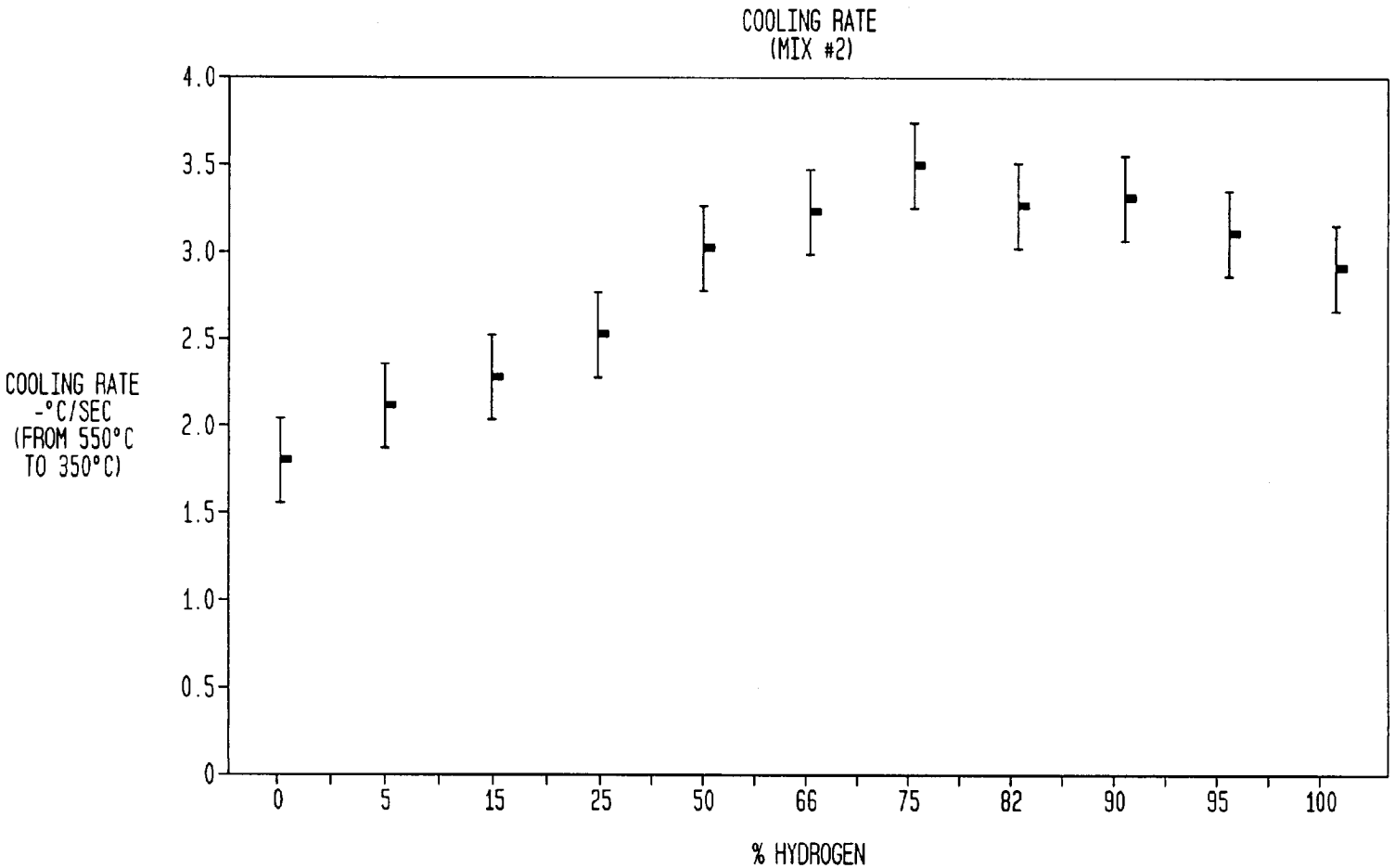
FIG. 7 is a plot of the cooling rate for a powder metal sample as a function of hydrogen content in a cooling atmosphere.

The cooling curve 614 (obtained from any of the embedded thermocouples) was used to derive cooling rates corresponding to different temperature ranges for a given sample. FIG. 7 illustrates a plot of the cooling rate as a function of $H_2$ concentration for a powder sample #2 within a temperature range of about 550° C. to about 350° C. At a $H_2$ concentration of about 15%, the cooling rate shows an increase of almost 30% compared to that obtained with 0% $H_2$, or 100% $N_2$. The cooling rate continued to increase with increasing $H_2$ concentrations, until at about 75% $H_2$, a maximum cooling rate of about 3.5° C./s was obtained. For this sample, there is a trend of a decrease in the cooling rate from its maximum when the $H_2$ concentration was increased from 75% to about 100%. It is believed that this decrease in the cooling rate results from a reduced $N_2$ content in the cooling atmosphere. For example, as a heavier molecule, $N_2$ has a larger thermal mass than $H_2$. The presence of a certain percentage of $N_2$ allows kinetic energy to be transferred from $H_2$ to $N_2$ through gas phase collisions. With the kinetic energy of the $H_2$ molecules thus reduced, additional thermal energy can be transferred from the sample to $H_2$, allowing further cooling of the sample.

Figure 8:
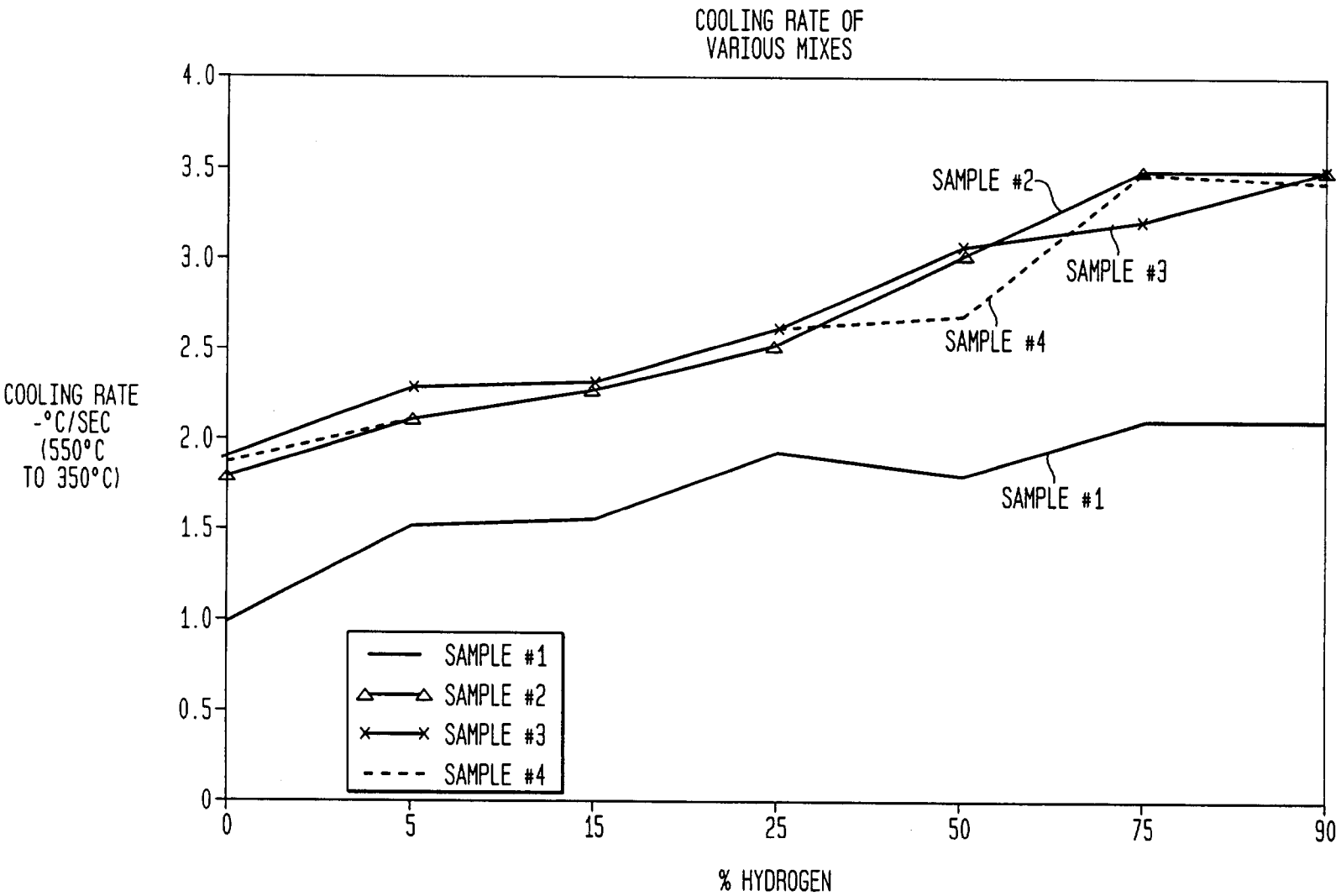
FIG. 8 is a plot of the cooling rates for four powder metal samples as a function of hydrogen content in a cooling atmosphere.

FIG. 8 illustrates a plot of the cooling rates for the four powder mix samples as a function of $H_2$ concentration in the cooling atmospheres. The overall cooling rate for Sample #1 was lower than those for Samples #2, #3 and #4, and can be attributed to a lower alloy content (e.g., lower weight percent for Ni, Mo, Mn and Cu). For each of the samples, however, the cooling rate increased with increasing $H_2$ concentrations. For example, a concentration of about 25% led to an increase in cooling rate of about 40% (compared to that of 100% $N_2$), while at about 75% or 90% $H_2$, the cooling rate was almost doubled.

For some of the tests conducted on Sample #3, the cooling gas flow velocity was also varied within a range from about 100 ft/s to about 350 ft/s. It was found that an increase in flow velocity, e.g., from about 200 ft/s to about 300 ft/s, resulted in an increase in cooling rate of at least about 20%, or at least about 30%; while a flow velocity change from about 200 ft/s to about 100 ft/s led to a decrease in cooling rate of at least about 30%. Although an increased cooling rate may be achieved by increasing gas flow velocity alone (e.g., with a 100% $N_2$ cooling atmosphere), this approach may result in increased equipment costs such as that associated with equipment upgrade, or may also result in unstable cooling atmosphere. Thus, depending on the specific applications, it may be preferable to combine the use of a hydrogen-containing cooling atmosphere with appropriate gas flow velocities in order to achieve cost-effective operations with improved processed parts. For example, a cooling gas flow velocity between about 100 ft/s and about 400 ft/s, preferably between about 150 ft/s and about 300 ft/s, may readily be used in practicing embodiments of the invention. It is understood that, depending on the specific application and furnace configuration, flow velocities outside of this range may also be acceptable.

Microstructure analyses performed on some of the samples indicated a correlation between an increase in $H_2$ concentration in the cooling atmosphere and an increased percentage of martensite phase in the processed samples. This observation is consistent with measurements of "apparent" hardness, expressed in Hardness Rockwell scale (HR), which is an indication of the overall average hardness for the sample. The hardness and microstructure analyses were performed on interior portions of the processed samples to allow for proper correlation with the cooling rates derived from the embedded thermocouples. Some of the analysis results are given in Table 2 below.

TABLE 2

| Samples | % $H_2$ | % Martensite | Hardness |
|---|---|---|---|
| #1 | 50% | — | 82.9 ± 4.7 HRB |
| #2 | 50% | — | 33.8 ± 1.3 HRC |
| #3 | 0% | 67.5 ± 1.5% | 31.5 ± 3.3 HRC |
| #3 | 50% | 71 ± 1% | 35.3 ± 1.2 HRC |
| #3 | 75% | 77.3 ± 1% | 37.8 ± 1.2 HRC |

Results obtained thus far suggest that improved microstructure (e.g., higher % of martensite) and increased hardness are correlated with accelerated cooling of the processed parts, which is correlated with increased $H_2$ in the cooling atmosphere. According to embodiments of the invention, a cooling atmosphere containing at least about 20% $H_2$, preferably at least about 50%, and more preferably between about 60% to about 95%, can be used for accelerated cooling to provide improved properties of powder metal parts.

While the present invention has been described with reference to several embodiments, as will occur to those skilled in the art, numerous changes, additions and omissions may be made without departing from the spirit and scope of the present invention.

What is claimed is:

1. A sintering furnace, comprising:

a heating zone for sintering a workpiece;

a cooling zone downstream of the heating zone;

at least one gas inlet disposed in at least one location within the heating zone or between the heating zone and the cooling zone, adapted to introduce a sintering feedgas into the heating zone and into the cooling zone;

at least one cooling gas inlet disposed in at least one location within the cooling zone or downstream of the cooling zone, adapted to introduce at least a portion of cooling gas into the cooling zone to establish a cooling atmosphere in the cooling zone differing in concentration from the sintering feedgas; and, means for inhibiting gas flow from the cooling zone to the heating zone.

2. The sintering furnace of claim 1, wherein said means for inhibiting gas flow comprises a curtain located between said cooling zone and said heating zone.

3. The sintering furnace of claim 2, wherein said sintering furnace is an open-ended furnace for operation at atmospheric pressure.

4. The sintering furnace of claim 3, wherein said cooling zone is provided by a convection cooler.

5. The sintering furnace of claim 1, wherein said means for inhibiting gas flow comprises an inert gas flow between said cooling zone and said heating zone.

6. The sintering furnace of claim 1, wherein a transition zone is disposed between the heating zone and the cooling zone.

7. The sintering furnace of claim 6, wherein the transition zone comprises a muffle.

8. The sintering furnace of claim 7, wherein at least one feedgas gas inlet is located within the muffle.

9. The sintering furnace of claim 1, further comprising means for providing a positive gas flow from the heating zone to the cooling zone.

10. The sintering furnace of claim 9, wherein the means for providing a positive gas flow comprises an auxiliary fan.

11. The sintering furnace of claim 1, further comprising means for providing a preferential gas flow from the heating zone to the cooling zone.

12. The sintering furnace of claim 11, wherein the means for providing preferential gas flow comprises the heating zone located at a lower height compared to the cooling zone and oriented in an inclined position.

13. The sintering furnace of claim 11, wherein the means for providing preferential gas flow comprises the cooling zone comprising a larger diameter compared to the heating zone.

14. The sintering furnace of claim 1, wherein said means for inhibiting gas flow comprises a curtain box disposed between the heating zone and the cooling zone.

* * * * *